US008065762B1

(12) United States Patent
Ewing

(10) Patent No.: US 8,065,762 B1
(45) Date of Patent: Nov. 29, 2011

(54) HAMMOCK ARCH

(76) Inventor: Jay Ewing, Austin, TX (US)

( * ) Notice: Subject to any disclaimer, the term of this patent is extended or adjusted under 35 U.S.C. 154(b) by 1206 days.

(21) Appl. No.: 11/236,190

(22) Filed: Sep. 27, 2005

Related U.S. Application Data

(60) Provisional application No. 60/522,414, filed on Sep. 28, 2004.

(51) Int. Cl.
*A45F 3/24* (2006.01)

(52) U.S. Cl. ..... 5/127; 5/129; 5/130

(58) Field of Classification Search ..... 5/127, 129–130; 472/118–125; 52/86, 87, 639, 644
See application file for complete search history.

(56) References Cited

U.S. PATENT DOCUMENTS

| | | | | |
|---|---|---|---|---|
| 2,251,299 | A | 1/1939 | Spangler | |
| 2,618,788 | A | 8/1946 | Cole et al. | |
| 2,699,201 | A * | 1/1955 | Levy | 472/120 |
| 4,229,845 | A | 10/1980 | de Cuadros | |
| 4,890,429 | A * | 1/1990 | Gatzka et al. | 52/640 |
| 5,035,012 | A * | 7/1991 | Westrich | 5/139 |
| 5,240,021 | A | 8/1993 | Snodgrass | |
| 5,931,740 | A * | 8/1999 | Kitchen | 472/118 |
| 5,950,649 | A * | 9/1999 | Gerig | 135/125 |
| 6,276,008 | B1 | 8/2001 | Chen | |
| 6,332,290 | B1 * | 12/2001 | Delamare | 52/2.22 |
| 6,360,383 | B1 * | 3/2002 | Tseng | 5/129 |
| 6,470,518 | B1 * | 10/2002 | Ke | 5/120 |
| 6,842,920 | B1 | 1/2005 | Branch, III | |
| 2002/0166171 | A1 | 11/2002 | Ke | |
| 2004/0098802 | A1 | 5/2004 | Lee | |

* cited by examiner

*Primary Examiner* — Michael Trettel
*Assistant Examiner* — William Kellehar
(74) *Attorney, Agent, or Firm* — Scheinberg & Griner, LLP; Michael O. Scheinberg; David Griner

(57) ABSTRACT

A hammock support is provided that includes an arched structure supported by tripod leg supports. The arched support is preferably a truss structure that provides multiple attachment points to support a hammock bed for varying the types, lengths, and heights of hammocks. In some embodiments, the arched truss structure includes multiple interlocked truss sections that can be assembled and disassembled without tools. The tripod leg supports provide stability for use in wet, uneven, or otherwise inhospitable terrain. The arched structure provides attachment locations for one or more accessories, such as mosquito netting, tents, tables, drink holders, lights, and other accessories. Additionally, the hammock support assembly of the invention is adapted to be used with one or more hammock support assemblies to create larger structures to create tents or bivouacs for camping or emergency shelter.

9 Claims, 4 Drawing Sheets

HAMMOCK ARCH

This application claims the benefit of U.S. Provisional Pat. App. No. 60/522,414 filed Sep. 28, 2004, which is hereby incorporated by reference.

TECHNICAL FIELD OF THE INVENTION

The present invention relates generally to hammocks and more particularly to an improved hammock arch assembly that provides strength and flexibility in use.

BACKGROUND OF THE INVENTION

Hammock assemblies are well known and are available in a variety of configurations. One example is shown and described in U.S. Pat. No. 2,251,299, in which a hammock is suspended from a connecting thrust bar assembly. The thrust bar assembly is constructed of interlocked steel tubing connected to support legs at each end. The hammock includes cords at each end that engage with hooks located on the support leg assemblies. Alternatively, the hammock may be suspended by chains at each end that extend through perforations formed in a socket plate in the support leg assemblies. This assembly has limited use in that there is only one point of connection at each end of the frame from which to suspend the hammock bed.

U.S. Pat. No. 2,618,788 shows and describes a hammock supporting assembly in which a hammock is suspended from a frame. The frame is constructed of a central tubular member having Y-shaped ends for connection to tubular support legs. The hammock is suspended from the frame by a chain that extends through a notch in the tubular support leg assemblies. This assembly is not modular and is not easily transportable. Another hammock is shown and described in U.S. Pat. No. 5,035,012, in which a hammock is suspended from a support frame. The support frame includes supporting leg structures with each leg structure having two ground-engaging support legs and a third support leg for connection with a crossover member. The crossover member is constructed of a single tubular member having a straight section with bent ends that interfit with the third support legs. This assembly is limited because the support frame includes only a single attachment point for the hammock. Additionally, the tubular construction provides less strength and stability than is often desired.

U.S. Pat. No. 6,276,008, shows and describes a hammock frame that includes tubular steel members connected in a square configuration. The frame includes two small legs at each end protruding diagonally out from the frame. The hammock is attached to the frame by a spring and hook at each end. This assembly is limited with only one attachment point at each end for the hammock bed. Additionally, this assembly requires a beam that extends underneath the hammock bed that could cause injury should the hammock bed fall.

Another hammock assembly is shown and described in U.S. Pat. No. 6,470,518, in which a bed net is supported between a pair of support frames connected by a connection tube set. The support frames each include three support rods connected at an upper end through a joint member. Each joint member includes a pedestal seat for connection with the associated support rod ends. The support frames are connected by a connection tube set that includes two interconnected tubular members. The bed net is connected to the support frames at each end by distal hooks that hook on cross bars in the pedestal seats. This assembly is complicated in design the single tubular frame structure does not provide optimal strength and support.

An arched hammock stand is shown and described in U.S. Pat. No. 6,842,920, in which two sets of support legs are joined together by a covering arch that extends up and over the hammock. The hammock is connected to cross braces bolted to the support legs. This assembly requires tools for assembly and is limited in design and use. What is needed is a hammock assembly that provides strength and stability for a variety of terrains and locations and uses.

SUMMARY OF THE INVENTION

An object of the invention is to provide a portable hammock support assembly that provides ease of assembly and disassembly, provides strength and stability regardless of terrain or ground conditions, and is easily convertible for a variety of uses.

The hammock support assembly includes an arched structure supported by tripod leg supports. The arched structure preferably provides multiple attachment points to support items, such as a hammock bed for varying the types, lengths, and heights of hammocks. The tripod leg supports provide stability for use in wet, uneven, or otherwise inhospitable terrain. The stability of the tripod leg supports and the strength of the arched structure provides ease of entry and exit for weight and balance support in any location.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF PREFERRED EMBODIMENTS

Figure 1:
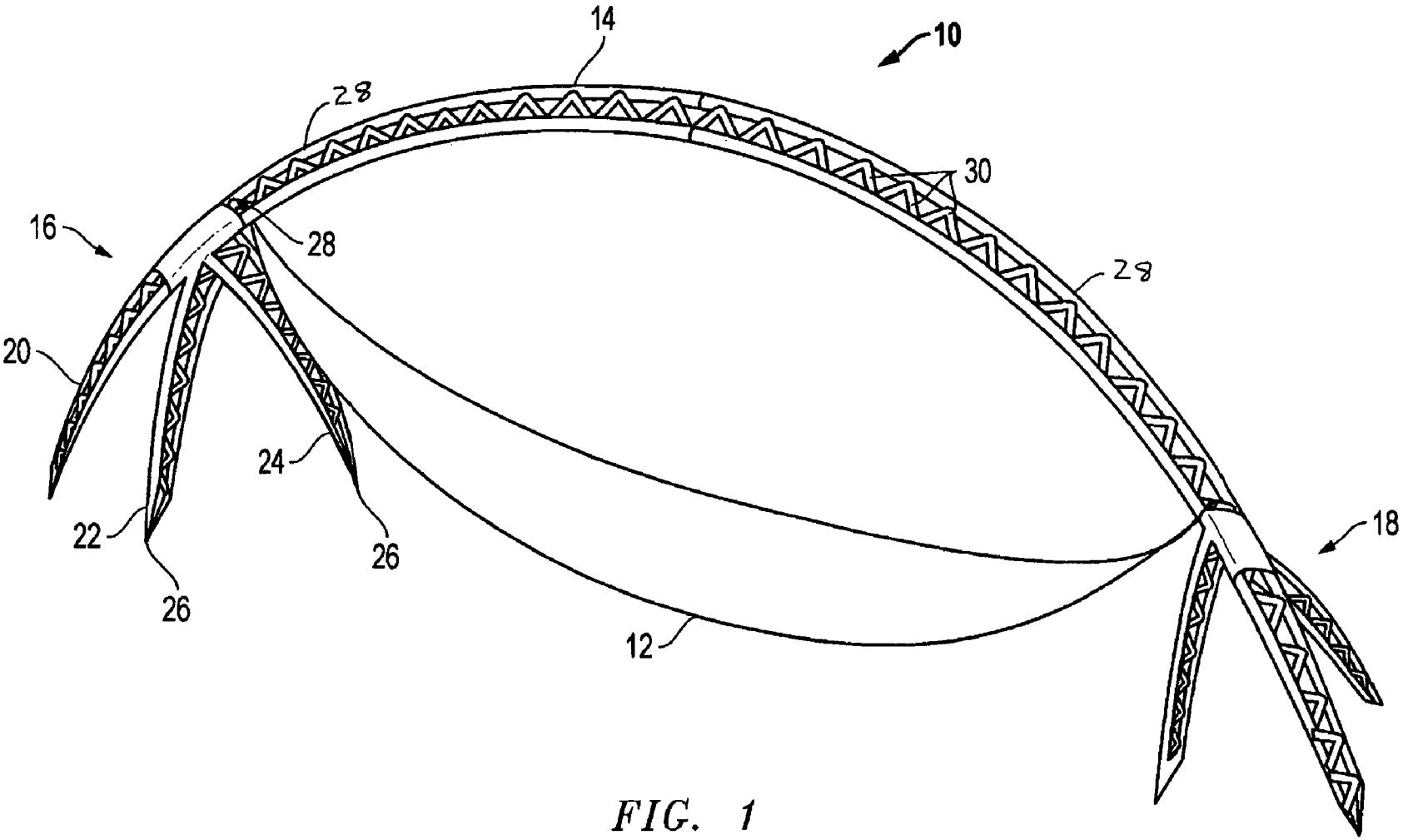
FIG. 1 is a perspective view of an embodiment of a hammock support assembly of the present invention.

A preferred embodiment of the hammock assembly of the invention includes an arched structure supported by tripod leg supports, the arch opening downward so that the high point of the arch is toward the center. The arched structure is preferably a truss structure, that is, it is composed of at least two longitudinal members and cross-support members, between the two longitudinal members, the cross-support members preferably extending at a non-normal angle to the longitudinal members.

The truss structure provides multiple attachment points to support a hammock bed for varying the types, lengths, and heights of hammocks. The strength of the truss permits the hammock support to be made of a thinner material than a comparable support using a non-truss structure. The truss can be of uniform width between the longitudinal members, or the width can be varied. For example, the longitudinal members may be further apart at the top and approach toward a point at the tripod leg, or the width between the longitudinal members may be partially tapered and partially uniform. While a truss with two longitudinal members is shown, a truss using three longitudinal members can also be used. The invention is not limited to use of a truss, or to any particular type of truss.

The tripod leg supports provide stability for use in wet, uneven, or otherwise inhospitable terrain. In one preferred embodiment, one leg of each tripod substantially conforms to the shape of the support arch, that is, one leg essentially forms an extension of the arch to the ground. To conform to the shape of the arch, the leg is not required to extend have the same curvature or to extend in the same direction as the arch, but just generally continues a shape from the arch to the ground. In some embodiments, one leg, in combination with the arch, forms a curve that could be mathematically characterized as a continuous, differentiable function, that is, a smooth curve from the arch to the ground.

The arch itself could extend to the ground to form one leg of the tripod, or one or more extension pieces could be attached to the arch and extend to the ground. The extension may have the same curve as the arch, or may be straight. The other two legs of the tripod typically extend sideways out of the plane of the arch support and may extend down and backward toward the center of the arch support. In other embodiments, the center leg can extend backward toward the center of the arch, rather than conforming to the arch curve, and the other two legs can extend away from the center of the arch support and toward the sides. For example, in some embodiments two legs of the tripod may extend in the same general direction as the arch but also to the sides, while a third leg extends backward toward the center of the arch. In yet another embodiment, two legs can extend in a plane perpendicular to the plane of the arch, with the third leg remaining in the plane of the arch, either extending toward or away from the center of the arch. The invention is not limited to any particular combination of angles of the support legs.

The stability of the tripod leg supports and the strength of the arched truss structure provides ease of entry and exit for weight and balance support in any location. The arched truss structure provides attachment locations for one or more accessories, such as mosquito netting, tents, tables, drink holders, lights, and other accessories. Additionally, some embodiments of hammock support assemblies of the invention are adapted to be used with one or more assemblies to create larger structures to create tents or bivouacs for camping or emergency shelter. The multiple truss structures can be fastened together, or each can be free standing, with an additional structure, such as a tent, suspended from the multiple truss structures.

The hammock arch assembly of a preferred embodiment provides an over arching truss structure that provides the user with flexibility in assembly and allowing for use on uneven ground and flexibility of attaching. The arched truss structure further includes multiple attachment points for a variety of accessories to provide comfort to the user and/or for suspending personal belongings of the user when the ground is wet.

A preferred embodiment of the invention is shown in FIGS. 1 and 3-6, in which a hammock assembly 10 supports an optional hammock bed 12. Hammock bed 12 may be of any type and is made of any desired material, preferably having sufficient strength to support a person. Hammock bed 12 is suspended from hammock assembly 10 and preferably includes a mechanism at each end for attachment to hammock assembly 10.

For example, hammock bed 12 may be suspended by any known type of devices such as hooks, clamps, carabiners, or ties (not shown) that may be connected at any location on assembly 10 to vary the length and/or height of hammock bed 12. Assembly 10 includes an overhead arch 14 supported by tripod leg assemblies 16 and 18. Overhead arch 14 preferably includes multiple truss sections 28 that are interconnected in a rigid framework. Tripod leg assemblies 16 and 18 are identical and, therefore, only one of the tripod leg assemblies will be discussed. Tripod leg assembly 16 includes a first leg 20, a second leg 22, and a third leg 24, each preferably formed as a truss to provide strength and rigidity. Each leg 20, 22, and 24 has a ground-engaging ends 26 and opposed ends 28 that converge to form a connection with overhead arch 14. First leg 20 is shown conforming to the curve of the arch 14.

Figure 2:
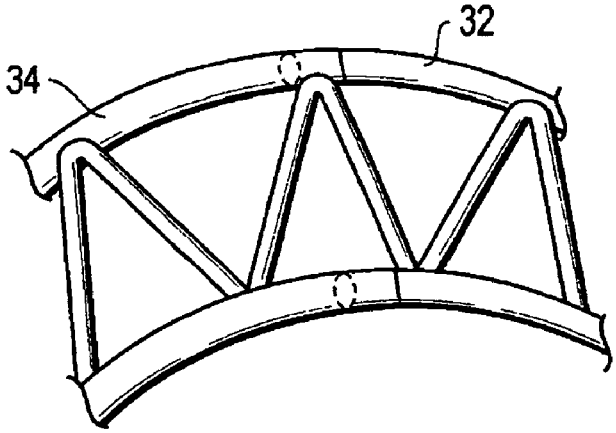
FIG. 2 an expanded partial view showing the connection between the modular truss sections of the hammock support assembly of FIG. 1.
Figure 3:
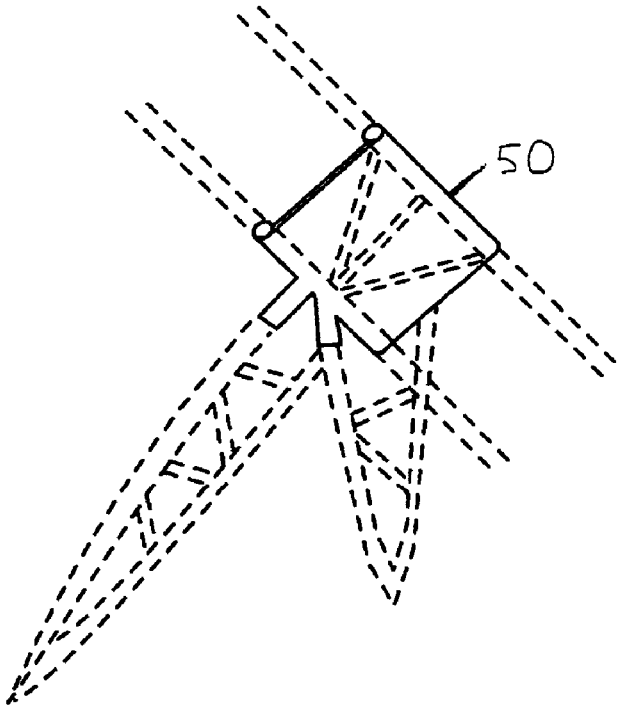
FIG. 3 shows a connector used to connect the leg supports to the arch.
Figure 4:
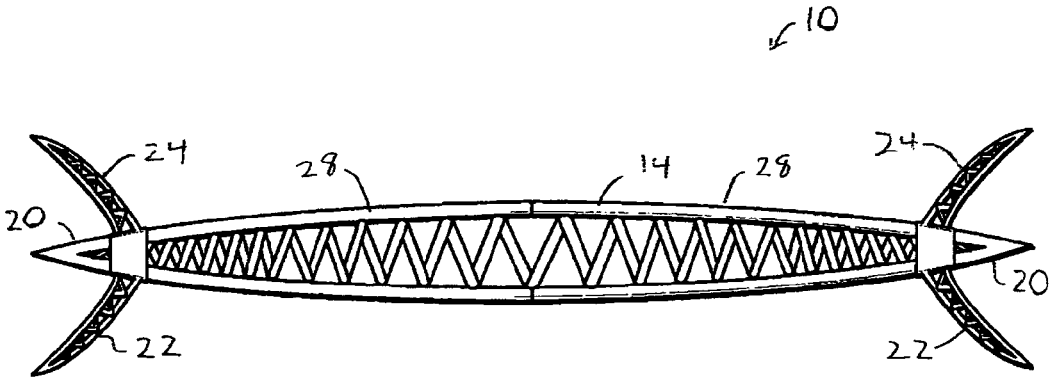
FIG. 4 shows a top view of the hammock assembly of FIG. 1.
Figure 5:
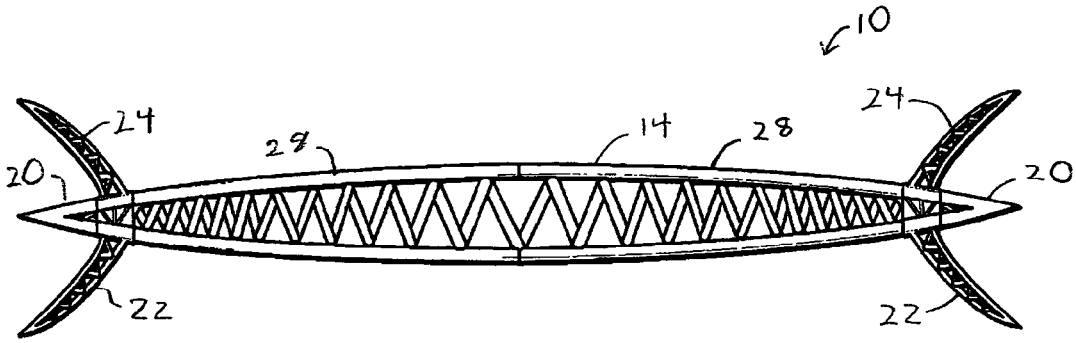
FIG. 5 shows a bottom view of the hammock assembly of FIG. 1.
Figure 6:
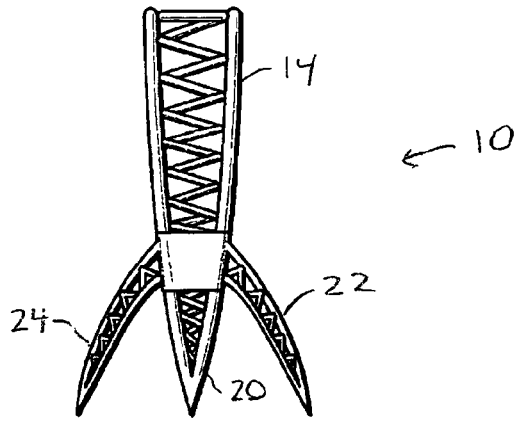
FIG. 6 shows a side view of the hammock assembly of FIG. 1.
Figure 7:
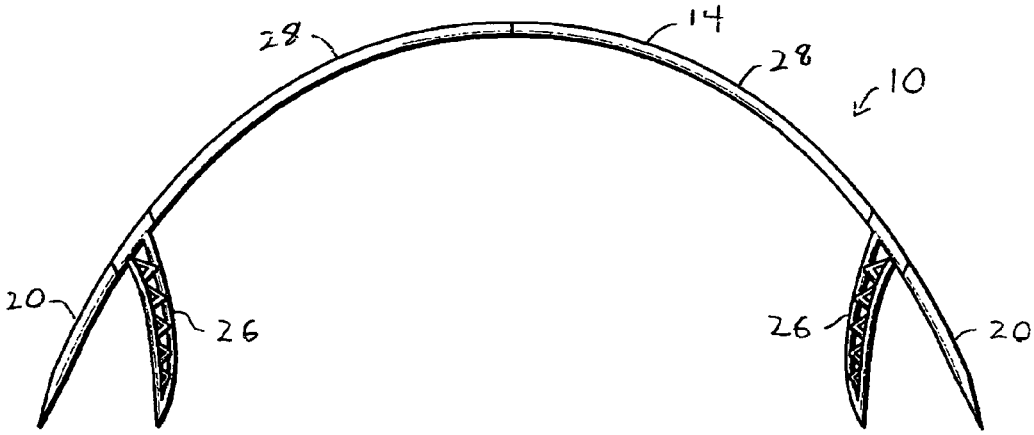
FIG. 7 shows a front view of the hammock assembly of FIG. 1.

Multiple truss sections 28 may be interconnected in any desired manner that provides a strong connection but that is preferably easily assembled and disassembled without tools. Likewise, overhead arch 14 may be interconnected in any desired manner to tripod leg assemblies 16 and 18, that provides a strong connection but that is easily assembled and disassembled without tools. One example of such a connection is a telescopic connection as seen in FIG. 2 in which the end of one member 32 is received within an adjacent member 34. The connection shown in FIG. 2 is an example of a connection between multiple truss sections 28, and/or between overhead arch 14 and tripod leg assemblies 16 and 18. The truss sections can connect directly to each other, or connectors can be used between the truss sections. FIG. 3 shows a similar connector 50 that attaches the tripod legs to the overhead arch structure. A single connector can connect both longitudinal members to the corresponding tripod, separate connectors can be used on each longitudinal member, or the connectors can be incorporated into one or more of the truss sections.

The truss structure of assembly 10 provides multiple attachment locations on one or several of the many horizontal truss members 30 for a variety of accessories, such as, tents, tarps, netting, shelving, drink holders, and guy wires. Thus, the invention is not limited to supporting a hammock. Accessories may be attached in any desired manner such as with hooks, clamps, clasps, or ties, and may be attached at any location on assembly 10. Additionally, assembly 10 is preferably made of a lightweight metal or fiberglass alloy for ease of transport, assembly, and disassembly. Assembly 10 can be used solely as a hammock support or as a full functioning camping structure that can support mosquito netting, shade tarps, full tents, storage bags, shelves, guy supports for wind, and dual hammock structures with the same capabilities. In another example of use, multiple arch assemblies may be connected together to create larger structures such as tents. For example, multiple arch assemblies may be connected by rods or poles at each end that extend through the truss structure. A tarp or other type of covering may then be connected to multiple arch assemblies to extend over and across the multiple arch assemblies to create a covered structure.

The arched structure provides attachment locations for one or more accessories, such as mosquito netting, tents, tables, drink holders, lights, and other accessories. Additionally, a preferred hammock assembly is adapted to be used with one or more hammock assemblies to create larger structures such as to create tents or bivouacs for camping or emergency shelter.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

I claim:

1. A hammock support, comprising:

an arch support wherein the arch opens downwardly, with the center higher than the ends, and in which at least part of the arch support comprises a truss including at least two longitudinal members and multiple cross members; and a tripod base at each end of the arch support, each tripod base including at least three legs, at least one of the three legs formed by an end of the arch support, wherein the tripod base includes at least one leg including a truss.

2. A hammock support comprising:

an arch support formed at least in part as a truss including at least two longitudinal members and multiple cross-supports between the two longitudinal members, the arch support including a center and two ends, wherein the arch support forms a downwardly opening arch within a plane, the arch formed of multiple removably interlocking sections;

at least three support members to support the arch support on each end, one of the three support members being the corresponding end of the arch support and being in the plane of the arch support, at least two of the support members extending out of the plane of the arch support; and a connector for suspending a hammock from the arch support.

3. The hammock support of claim 2 in which one section includes a mount for the at least two support members.

4. A method of making a hammock support, comprising:

providing an arch support conforming to the shape of an arch along a plane, and wherein the arch support comprises a downwardly opening center portion and two ends, the center portion comprising a truss which includes at least two longitudinal members and multiple cross-supports between the two longitudinal members; and providing at least three support members to support the arch support on each of the two end ends, one of the three support members being an end of the arch support in the plane of the arch support.

5. The method of claim 4 in which providing at least three support members to support the arch support on each end includes providing at least one support member on each end that substantially conforms to the curve of the arch.

6. The method of claim 4 further comprising suspending a hammock from the hammock support.

7. The hammock support of claim 1 wherein at least one of the three legs further includes a truss.

8. The hammock support of claim 2 wherein the at least two support members or a distal end further comprises a truss.

9. The method of claim 4 wherein at least one of the three support members further comprises a truss.

* * * * *